US009640190B2

(12) United States Patent
Hiwasaki et al.

(10) Patent No.: US 9,640,190 B2
(45) Date of Patent: May 2, 2017

(54) DECODING METHOD, DECODING APPARATUS, PROGRAM, AND RECORDING MEDIUM THEREFOR

(71) Applicant: NIPPON TELEGRAPH AND TELEPHONE CORPORATION, Chiyoda-ku (JP)

(72) Inventors: Yusuke Hiwasaki, Tokyo (JP); Takehiro Moriya, Kanagawa (JP); Noboru Harada, Kanagawa (JP); Yutaka Kamamoto, Kanagawa (JP); Masahiro Fukui, Tokyo (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 0 days.

(21) Appl. No.: 14/418,328

(22) PCT Filed: Aug. 28, 2013

(86) PCT No.: PCT/JP2013/072947
§ 371 (c)(1),
(2) Date: Jan. 29, 2015

(87) PCT Pub. No.: WO2014/034697
PCT Pub. Date: Mar. 6, 2014

(65) Prior Publication Data

US 2015/0194163 A1 Jul. 9, 2015

(30) Foreign Application Priority Data

Aug. 29, 2012 (JP) ..... 2012-188462

(51) Int. Cl.
*G10L 19/125* (2013.01)
*G10L 19/02* (2013.01)
*G10L 19/26* (2013.01)

(52) U.S. Cl.
CPC ..... *G10L 19/125* (2013.01); *G10L 19/26* (2013.01); *G10L 19/02* (2013.01)

(58) Field of Classification Search
CPC ..... G10L 19/012
See application file for complete search history.

(56) References Cited

U.S. PATENT DOCUMENTS 5,327,520 A * 7/1994 Chen ..... G10L 19/12 704/200
5,657,422 A * 8/1997 Janiszewski ..... G10L 19/012 704/229

(Continued)

FOREIGN PATENT DOCUMENTS

CN 1132988 A 10/1996
JP 09-054600 A 2/1997

(Continued)

OTHER PUBLICATIONS

Chen, Juin-Hwey, and Allen Gersho. "Adaptive postfiltering for quality enhancement of coded speech." Speech and Audio Processing, IEEE Transactions on 3.1 (1995): 59-71.*

(Continued)

*Primary Examiner* — Brian Albertalli
(74) *Attorney, Agent, or Firm* — Oblon, McClelland, Maier & Neustadt, L.L.P.

(57) ABSTRACT

In a speech coding scheme based on a speech production model, such as a CELP-based scheme, an object of the present invention is to provide a decoding method that can reproduce natural sound even if the input signal is a noise-superimposed speech. The decoding method includes a speech decoding step of obtaining a decoded speech signal from an input code, a noise generating step of generating a noise signal that is a random signal, and a noise adding step of outputting a noise-added signal, the noise-added signal being obtained by summing the decoded speech signal and (Continued)

a signal obtained by performing, on the noise signal, a signal processing that is based on at least one of a power corresponding to a decoded speech signal for a previous frame and a spectrum envelope corresponding to the decoded speech signal for the current frame.

9 Claims, 12 Drawing Sheets

(56) References Cited

U.S. PATENT DOCUMENTS 5,717,724 A * 2/1998 Yamazaki ..... G10L 19/12 375/346
5,787,388 A * 7/1998 Hayata ..... G10L 19/012 704/215
6,108,623 A * 8/2000 Morel ..... G10L 19/012 704/219
6,122,611 A * 9/2000 Su ..... G10L 21/0364 704/219
6,301,556 B1 * 10/2001 Hagen ..... G10L 19/12 704/201
6,691,085 B1 2/2004 Rotola-Pukkila et al.
6,910,009 B1 * 6/2005 Murashima ..... G10L 21/0364 704/223
7,577,567 B2 8/2009 Ehara
7,610,197 B2 * 10/2009 Cruz-Zeno ..... G10L 19/012 704/226
2001/0029451 A1 * 10/2001 Matsuoka ..... G10L 19/012 704/233
2002/0128828 A1 * 9/2002 Gao ..... G10L 19/08 704/223
2002/0161573 A1 * 10/2002 Yoshida ..... G10L 19/18 704/201
2002/0173951 A1 11/2002 Ehara
2005/0256705 A1 11/2005 Kazama et al.
2006/0116874 A1 * 6/2006 Samuelsson ..... G10L 19/26 704/228
2006/0153402 A1 * 7/2006 Suzuki ..... G10L 19/028 381/98
2007/0088543 A1 4/2007 Ehara
2008/0221906 A1 * 9/2008 Nilsson ..... G10L 21/0364 704/500
2009/0240490 A1 * 9/2009 Kim ..... G10L 19/005 704/207
2010/0114585 A1 * 5/2010 Yoon ..... G10L 19/028 704/500
2010/0286805 A1 * 11/2010 Gao ..... G10L 19/0017 700/94
2013/0332176 A1 * 12/2013 Setiawan ..... G10L 19/012 704/500

FOREIGN PATENT DOCUMENTS

JP 2000-235400 A 8/2000
JP 2004-302258 A 10/2004
JP 2005-284163 A 10/2005
JP 2009-69856 A 4/2009
WO WO 2008/108082 A1 9/2008

OTHER PUBLICATIONS

Office Action issued Nov. 13, 2015 in Korean Patent Application No. 10-2015-7003110 (with English language translation).
International Search Report issued Oct. 1, 2013 in PCT/JP2013/072947 Filed Aug. 28, 2013.
Manfred R. Schroeder, et al., "Code-excited linear prediction (CELP): High-quality speech at very low bit rates", IEEE Proc. ICASSP-85, 1985, pp. 937-940.
Adil Benyassine, et al., "ITU-T recommendation G.729 Annex B: A silence compression scheme for use with G.729 optimized for V.70 digital simultaneous voice and data applications", IEEE Communications Magazine, vol. 35, No. 9, Sep. 1997, pp. 64-73.
Japanese Office Action issued Nov. 4, 2015 in Patent Application No. 2014-533035 (with English translation).
Extended European Search Report issued May 3, 2016 in Patent Application No. 13832346.4.
Japanese Office Action issued May 17, 2016 in Patent Application No. 2014-533035 (with English language translation).
Office Action mailed Oct. 19, 2016 in Chinese Application No. 201380044549.4 (w/English translation).

* cited by examiner

Prior Art

DECODING METHOD, DECODING APPARATUS, PROGRAM, AND RECORDING MEDIUM THEREFOR

TECHNICAL FIELD

The present invention relates to a decoding method of decoding a digital code produced by digitally encoding an audio or video signal sequence, such as speech or music, with a reduced amount of information, a decoding apparatus, a program, and a recording medium therefor.

BACKGROUND ART

Today, as an efficient speech coding method, a method is proposed which processes an input signal sequence (in particular, speech) in units of sections (frames) having a certain duration of about 5 to 20 ms included in an input signal, for example. The method involves separating one frame of speech into two types of information, that is, linear filter characteristics that represent envelope characteristics of a frequency spectrum and a driving sound source signal for driving the filter, and separately encodes the two types of information. A known method of encoding the driving sound source signal in this method is a code-excited linear prediction (CELP) that separates a speech into a periodic component that is considered to correspond to a pitch frequency (fundamental frequency) of the speech and the other component (see Non-patent literature 1).

With reference to FIGS. 1 and 2, an encoding apparatus 1 according to prior art will be described. FIG. 1 is a block diagram showing a configuration of the encoding apparatus 1 according to prior art. FIG. 2 is a flow chart showing an operation of the encoding apparatus 1 according to prior art. As shown in FIG. 1, the encoding apparatus 1 comprises a linear prediction analysis part 101, a linear prediction coefficient encoding part 102, a synthesis filter part 103, a waveform distortion calculating part 104, a code book search controlling part 105, a gain code book part 106, a driving sound source vector generating part 107, and a synthesis part 108. In the following, an operation of each component of the encoding apparatus 1 will be described.

<Linear Prediction Analysis Part 101>

The linear prediction analysis part 101 receives an input signal sequence $x_F(n)$ in units of frames that is composed of a plurality of consecutive samples included in an input signal x(n) in the time domain (n=0, . . . , L−1, where L denotes an integer equal to or greater than 1). The linear prediction analysis part 101 receives the input signal sequence $x_F(n)$ and calculates a linear prediction coefficient a(i) that represents frequency spectrum envelope characteristics of an input speech (i represents a prediction order, i=1, . . . , P, where P denotes an integer equal to or greater than 1) (S101). The linear prediction analysis part 101 may be replaced with a non-linear one.

<Linear Prediction Coefficient Encoding Part 102>

The linear prediction coefficient encoding part 102 receives the linear prediction coefficient a(i), quantizes and encodes the linear prediction coefficient a(i) to generate a synthesis filter coefficient $\hat{a}(i)$ and a linear prediction coefficient code, and outputs the synthesis filter coefficient $\hat{a}(i)$ and the linear prediction coefficient code (S102). Note that $\hat{a}(i)$ means a superscript hat of a(i). The linear prediction coefficient encoding part 102 may be replaced with a non-linear one.

<Synthesis Filter Part 103>

The synthesis filter part 103 receives the synthesis filter coefficient $\hat{a}(i)$ and a driving sound source vector candidate c(n) generated by the driving sound source vector generating part 107 described later. The synthesis filter part 103 performs a linear filtering processing on the driving sound source vector candidate c(n) using the synthesis filter coefficient $\hat{a}(i)$ as a filter coefficient to generate an input signal candidate $\hat{x}_F(n)$ and outputs the input signal candidate $\hat{x}_F(n)$ (S103). Note that $\hat{x}$ means a superscript hat of x. The synthesis filter part 103 may be replaced with a non-linear one.

<Waveform Distortion Calculating Part 104>

The waveform distortion calculating part 104 receives the input signal sequence $x_F(n)$, the linear prediction coefficient a(i), and the input signal candidate $\hat{x}_F(n)$. The waveform distortion calculating part 104 calculates a distortion d for the input signal sequence $x_F(n)$ and the input signal candidate $\hat{x}_F(n)$ (S104). In many cases, the distortion calculation is conducted by taking the linear prediction coefficient a(i) (or the synthesis filter coefficient $\hat{a}(i)$) into consideration.

<Code Book Search Controlling Part 105>

The code book search controlling part 105 receives the distortion d, and selects and outputs driving sound source codes, that is, a gain code, a period code and a fixed (noise) code used by the gain code book part 106 and the driving sound source vector generating part 107 described later (S105A). If the distortion d is a minimum value or a quasi-minimum value (S105BY), the process proceeds to Step S108, and the synthesis part 108 described later starts operating. On the other hand, if the distortion d is not the minimum value nor the quasi-minimum value (S105BN), Steps S106, S107, S103 and S104 are sequentially performed, and then the process returns to Step S105A, which is an operation performed by this component. Therefore, as far as the process proceeds to the branch of Step S105BN, Steps S106, S107, S103, S104 and S105A are repeatedly performed, and eventually the code book search controlling part 105 selects and outputs the driving sound source codes for which the distortion d for the input signal sequence $x_F(n)$ and the input signal candidate $\hat{x}_F(n)$ is minimal or quasi-minimal (S105BY).

<Gain Code Book Part 106>

The gain code book part 106 receives the driving sound source codes, generates a quantized gain (gain candidate) $g_a, g_r$ from the gain code in the driving sound source codes and outputs the quantized gain $g_a, g_r$ (S106).

<Driving Sound Source Vector Generating Part 107>

The driving sound source vector generating part 107 receives the driving sound source codes and the quantized gain (gain candidate) $g_a, g_r$ and generates a driving sound source vector candidate c(n) having a length equivalent to one frame from the period code and the fixed code included in the driving sound source codes (S107). In general, the driving sound source vector generating part 107 is often composed of an adaptive code book and a fixed code book. The adaptive code book generates a candidate of a time-series vector that corresponds to a periodic component of the speech by cutting the immediately preceding driving sound source vector (one to several frames of driving sound source vectors having been quantized) stored in a buffer into a vector segment having a length equivalent to a certain period based on the period code and repeating the vector segment until the length of the frame is reached, and outputs the candidate of the time-series vector. As the "certain period" described above, the adaptive code book selects a period for which the distortion d calculated by the waveform distortion calculating part 104 is small. In many cases, the selected period is equivalent to the pitch period of the speech. The fixed code book generates a candidate of a time-series code vector having a length equivalent to one frame that corresponds to a non-periodic component of the speech based on the fixed code, and outputs the candidate of the time-series code vector. These candidates may be one of a specified number of candidate vectors stored independently of the input speech according to the number of bits for encoding, or one of vectors generated by arranging pulses according to a predetermined generation rule. The fixed code book intrinsically corresponds to the non-periodic component of the speech. However, in a speech section with a high pitch periodicity, in particular, in a vowel section, a fixed code vector may be produced by applying a comb filter having a pitch period or a period corresponding to the pitch used in the adaptive code book to the previously prepared candidate vector or cutting a vector segment and repeating the vector segment as in the processing for the adaptive code book. The driving sound source vector generating part 107 generates the driving sound source vector candidate c(n) by multiplying the candidates $c_a(n)$ and $c_r(n)$ of the time-series vector output from the adaptive code book and the fixed code book by the gain candidate $g_a,g_r$ output from the gain code book part 23 and adding the products together. Some actual operation may involve only one of the adaptive code book and the fixed code book.

<Synthesis Part 108>

The synthesis part 108 receives the linear prediction coefficient code and the driving sound source codes, and generates and outputs a synthetic code of the linear prediction coefficient code and the driving sound source codes (S108). The resulting code is transmitted to a decoding apparatus 2.

Next, with reference to FIGS. 3 and 4, the decoding apparatus 2 according to prior art will be described. FIG. 3 is a block diagram showing a configuration of the decoding apparatus 2 according to prior art that corresponds to the encoding apparatus 1. FIG. 4 is a flow chart showing an operation of the decoding apparatus 2 according to prior art. As shown in FIG. 3, the decoding apparatus 2 comprises a separating part 109, a linear prediction coefficient decoding part 110, a synthesis filter part 111, a gain code book part 112, a driving sound source vector generating part 113, and a post-processing part 114. In the following, an operation of each component of the decoding apparatus 2 will be described.

<Separating Part 109>

The code transmitted from the encoding apparatus 1 is input to the decoding apparatus 2. The separating part 109 receives the code and separates and retrieves the linear prediction coefficient code and the driving sound source code from the code (S109).

<Linear Prediction Coefficient Decoding Part 110>

The linear prediction coefficient decoding part 110 receives the linear prediction coefficient code and decodes the liner prediction coefficient code into the synthesis filter coefficient $\hat{a}(i)$ in a decoding method corresponding to the encoding method performed by the linear prediction coefficient encoding part 102 (S110).

<Synthesis Filter Part 111>

The synthesis filter part 111 operates the same as the synthesis filter part 103 described above. That is, the synthesis filter part 111 receives the synthesis filter coefficient $\hat{a}(i)$ and the driving sound source vector candidate c(n). The synthesis filter part 111 performs the linear filtering processing on the driving sound source vector candidate c(n) using the synthesis filter coefficient $\hat{a}(i)$ as a filter coefficient to generate $\hat{x}_F(n)$ (referred to as a synthesis signal sequence $\hat{x}_F(n)$ in the decoding apparatus) and outputs the synthesis signal sequence $\hat{x}_F(n)$ (S111).

<Gain Code Book Part 112>

The gain code book part 112 operates the same as the gain code book part 106 described above. That is, the gain code book part 112 receives the driving sound source codes, generates $g_a,g_r$ (referred to as a decoded gain $g_a,g_r$ in the decoding apparatus) from the gain code in the driving sound source codes and outputs the decoded gain $g_a,g_r$ (S112).

<Driving Sound Source Vector Generating Part 113>

The driving sound source vector generating part 113 operates the same as the driving sound source vector generating part 107 described above. That is, the driving sound source vector generating part 113 receives the driving sound source codes and the decoded gain $g_a,g_r$ and generates c(n) (referred to as a driving sound source vector c(n) in the decoding apparatus) having a length equivalent to one frame from the period code and the fixed code included in the driving sound source codes and outputs the c(n) (S113).

<Post-Processing Part 114>

The post-processing part 114 receives the synthesis signal sequence $\hat{x}_F(n)$. The post-processing part 114 performs a processing of spectral enhancement or pitch enhancement on the synthesis signal sequence $\hat{x}_F(n)$ to generate an output signal sequence $z_F(n)$ with a less audible quantized noise and outputs the output signal sequence $z_F(n)$ (S114).

PRIOR ART LITERATURE

Non-Patent Literature

Non-patent literature 1: M. R. Schroeder and B. S. Atal, "Code-Excited Linear Prediction (CELP): High Quality Speech at Very Low Bit Rates", IEEE Proc. ICASSP-85, pp. 937-940, 1985

SUMMARY OF THE INVENTION

Problems to be Solved by the Invention

The encoding scheme based on the speech production model, such as the CELP-based encoding scheme, can achieve high-quality encoding with a reduced amount of information. However, if a speech recorded in an environment with background noise such as in an office or on a street (referred to as a noise-superimposed speech, hereinafter) is input, a problem of a perceivable uncomfortable sound arises because the model cannot be applied to the background noise, which has different properties from the speech, and therefore a quantization distortion occurs. In view of such a circumstance, an object of the present invention is to provide a decoding method that can reproduce a natural sound even if the input signal is a noise-superimposed speech in a speech coding scheme based on a speech production model, such as a CELP-based scheme.

Means to Solve the Problems

A decoding method according to the present invention comprises a speech decoding step, a noise generating step, and a noise adding step. In the speech decoding step, a decoded speech signal is obtained from an input code. In the noise generating step, a noise signal that is a random signal is generated. In the noise adding step, a noise-added signal is output, which is obtained by summing the decoded speech signal and a signal obtained by performing, on the noise signal, a signal processing that is based on at least one of a power corresponding to a decoded speech signal for a previous frame and a spectrum envelope corresponding to the decoded speech signal for the current frame.

Effects of the Invention

According to the decoding method according to the present invention, in a speech coding scheme based on a speech production model, such as a CELP-based scheme, even if the input signal is a noise-superimposed speech, the quantization distortion caused by the model not being applicable to the noise-superimposed speech is masked so that the uncomfortable sound becomes less perceivable, and a more natural sound can be reproduced.

DETAILED DESCRIPTION OF THE EMBODIMENTS

Figure 1:
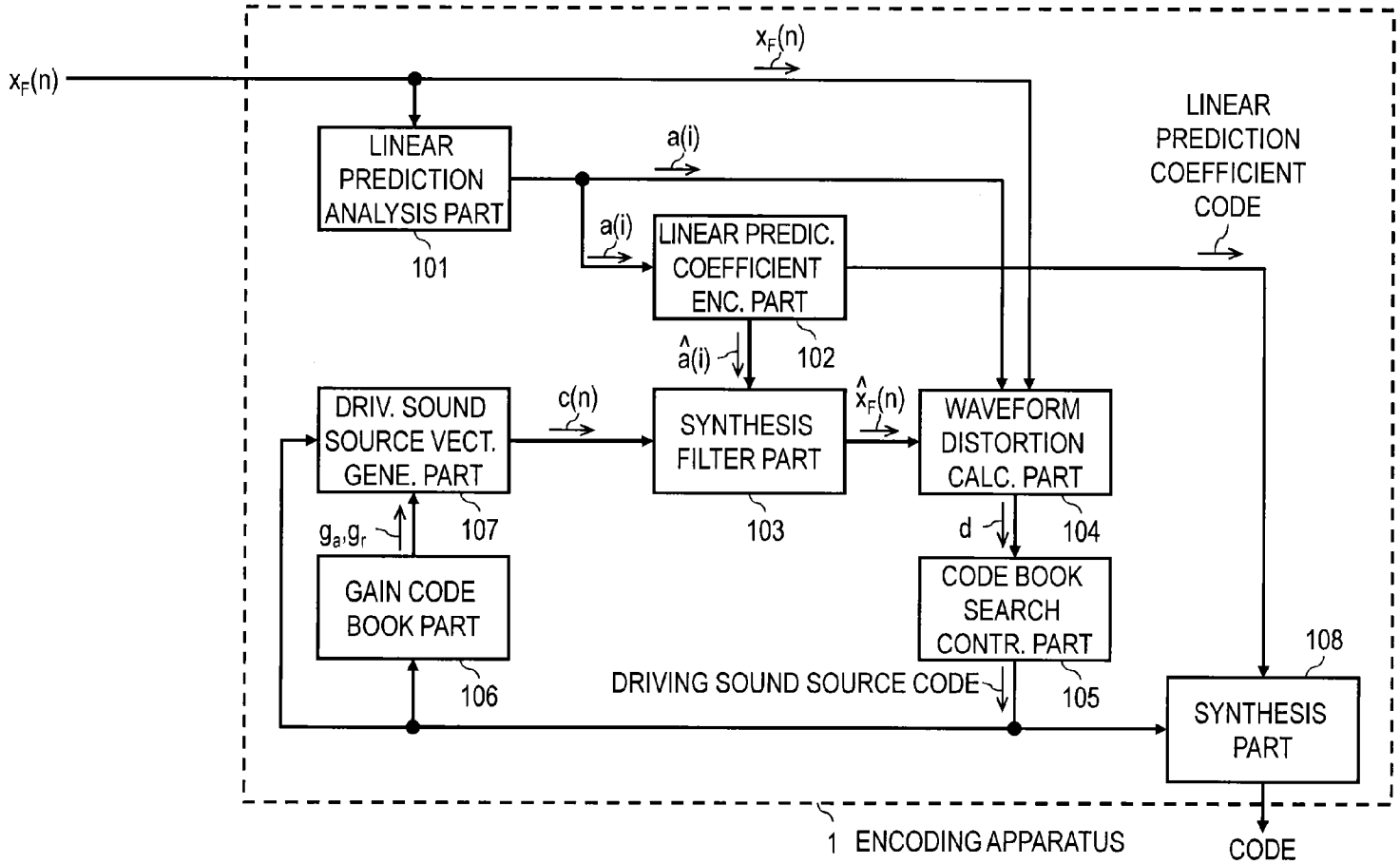
FIG. 1 Prior Art
FIG. 1 is a block diagram showing a configuration of an encoding apparatus according to prior art.
Figure 2:
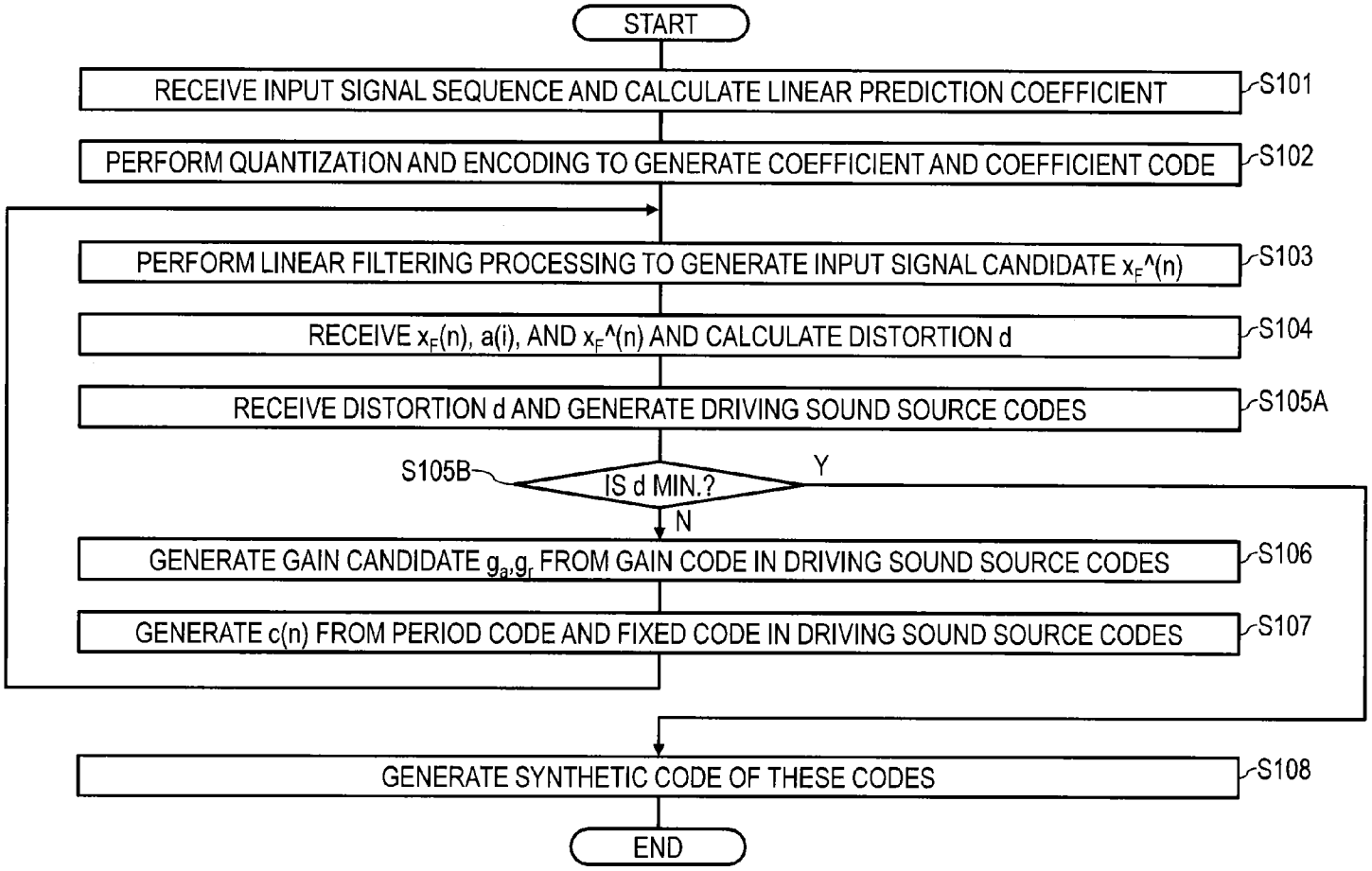
FIG. 2 Prior Art
FIG. 2 is a flow chart showing an operation of the encoding apparatus according to prior art.
Figure 3:
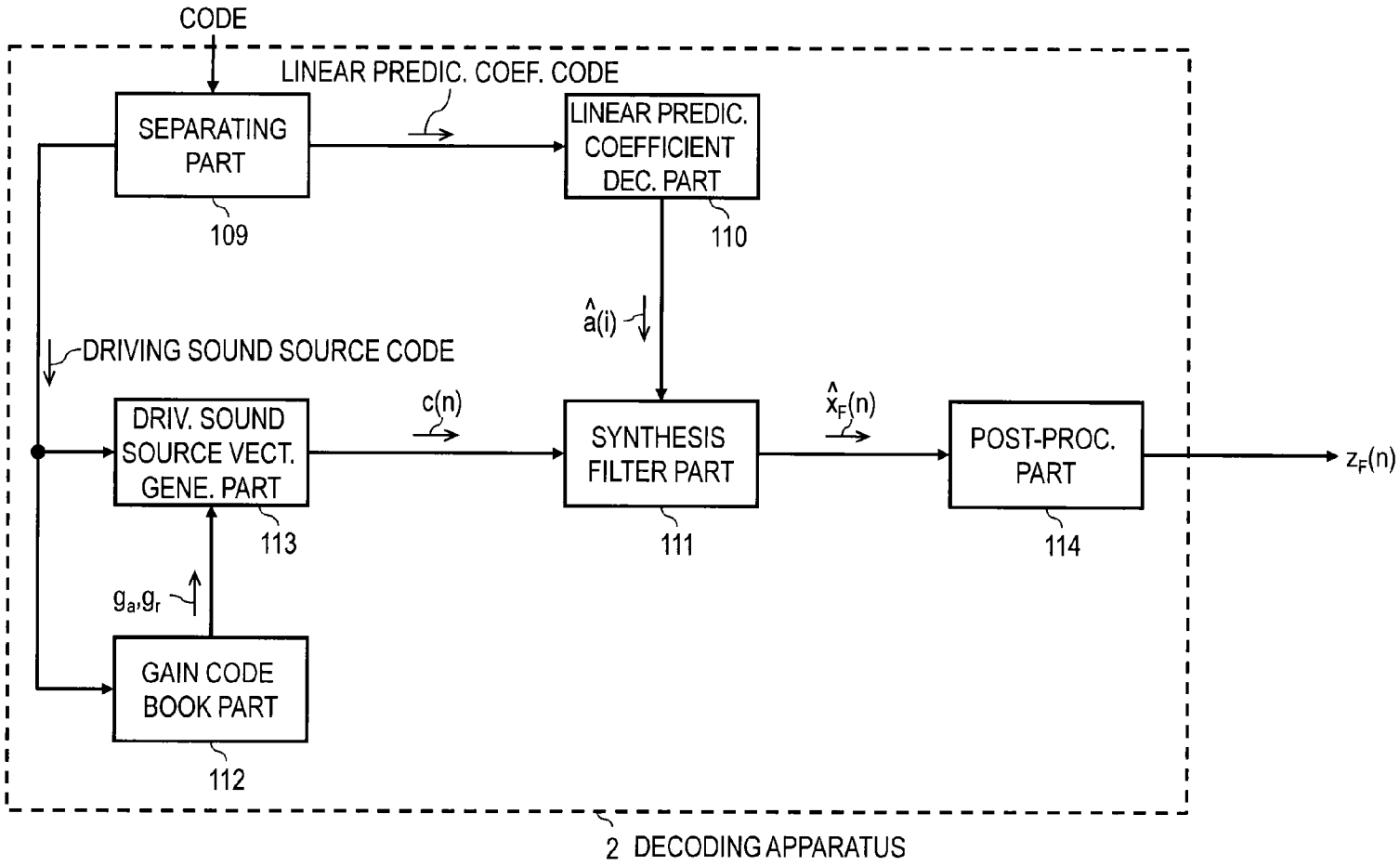
FIG. 3 Prior Art
FIG. 3 is a block diagram showing a configuration of an decoding apparatus according to prior art.
Figure 4:
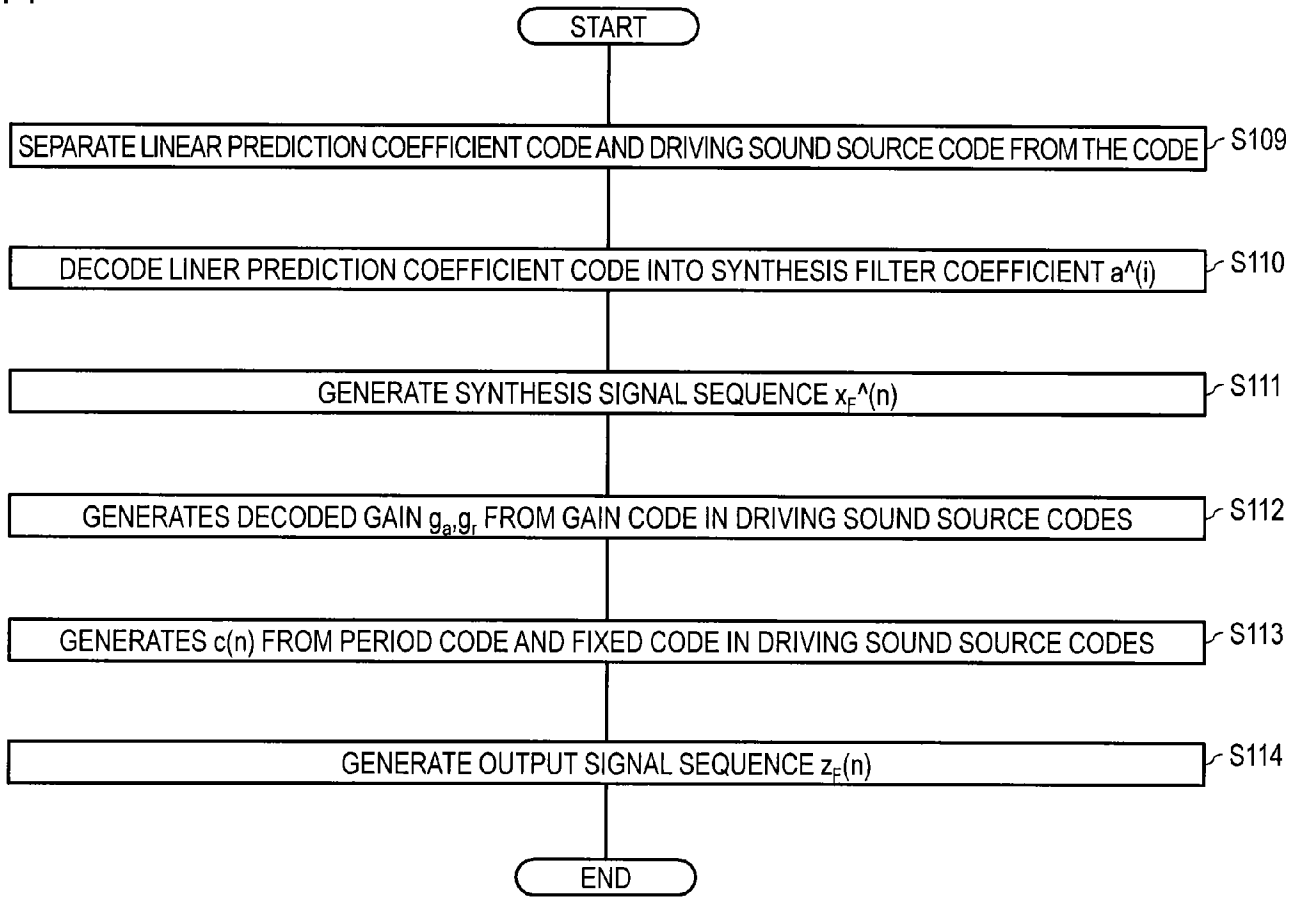
FIG. 4 is a flow chart showing an operation of the decoding apparatus according to prior art.

In the following, an embodiment of the present invention will be described in detail. Components having the same function will be denoted by the same reference numeral, and redundant descriptions thereof will be omitted.

First Embodiment

Figure 5:
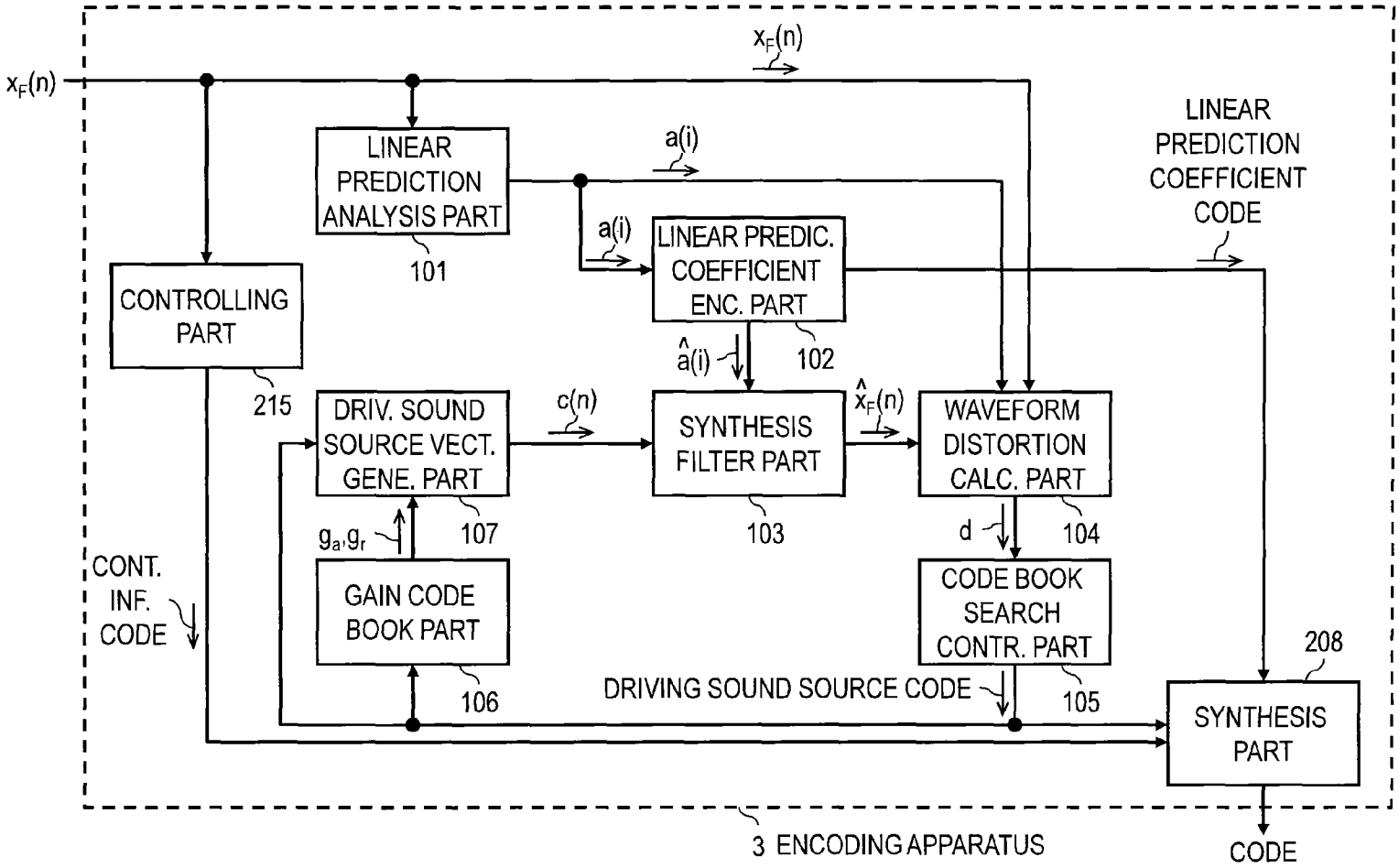
FIG. 5 is a block diagram showing a configuration of an encoding apparatus according to a first embodiment.
Figure 6:
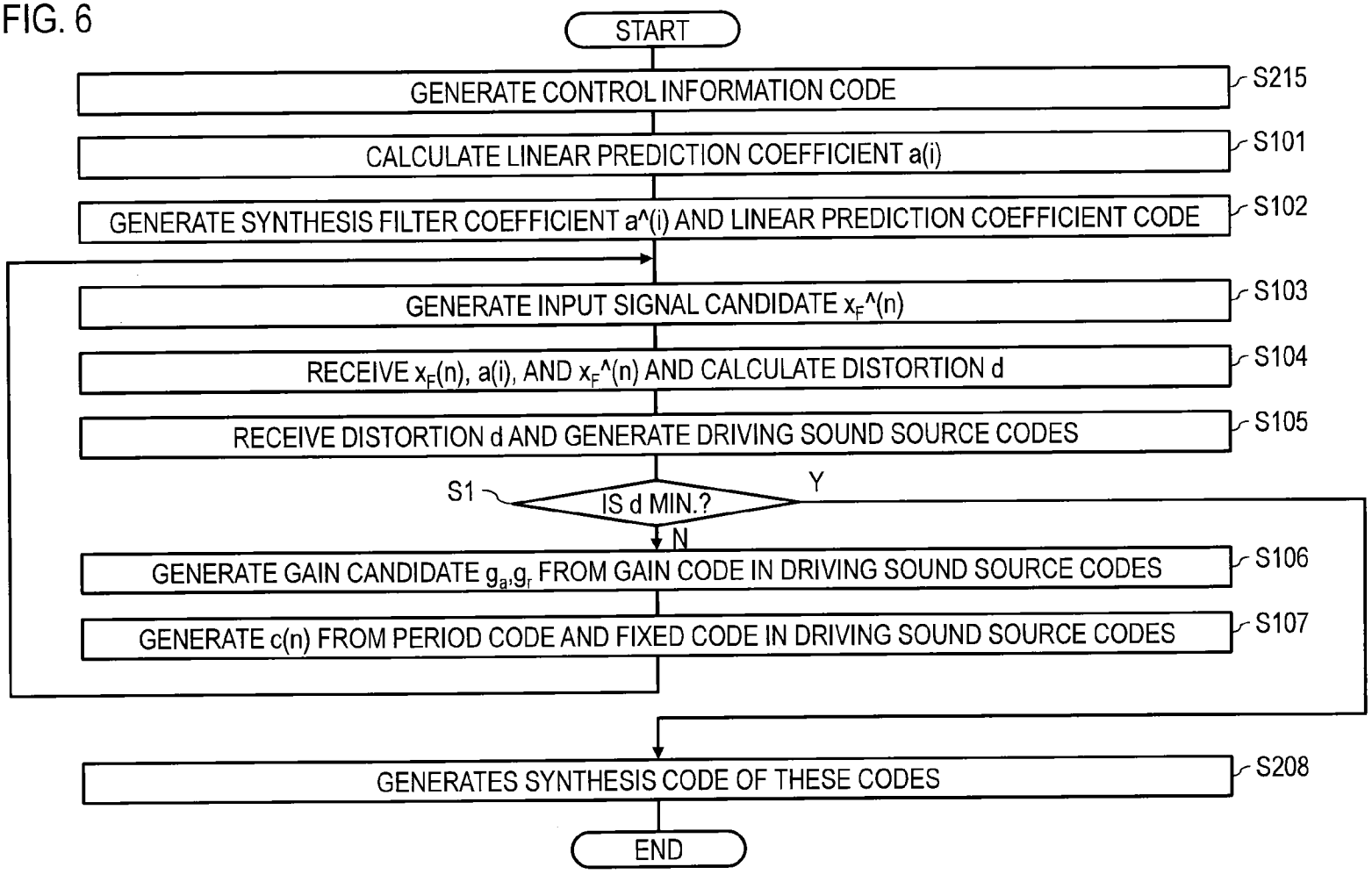
FIG. 6 is a flow chart showing an operation of the encoding apparatus according to the first embodiment.
Figure 7:
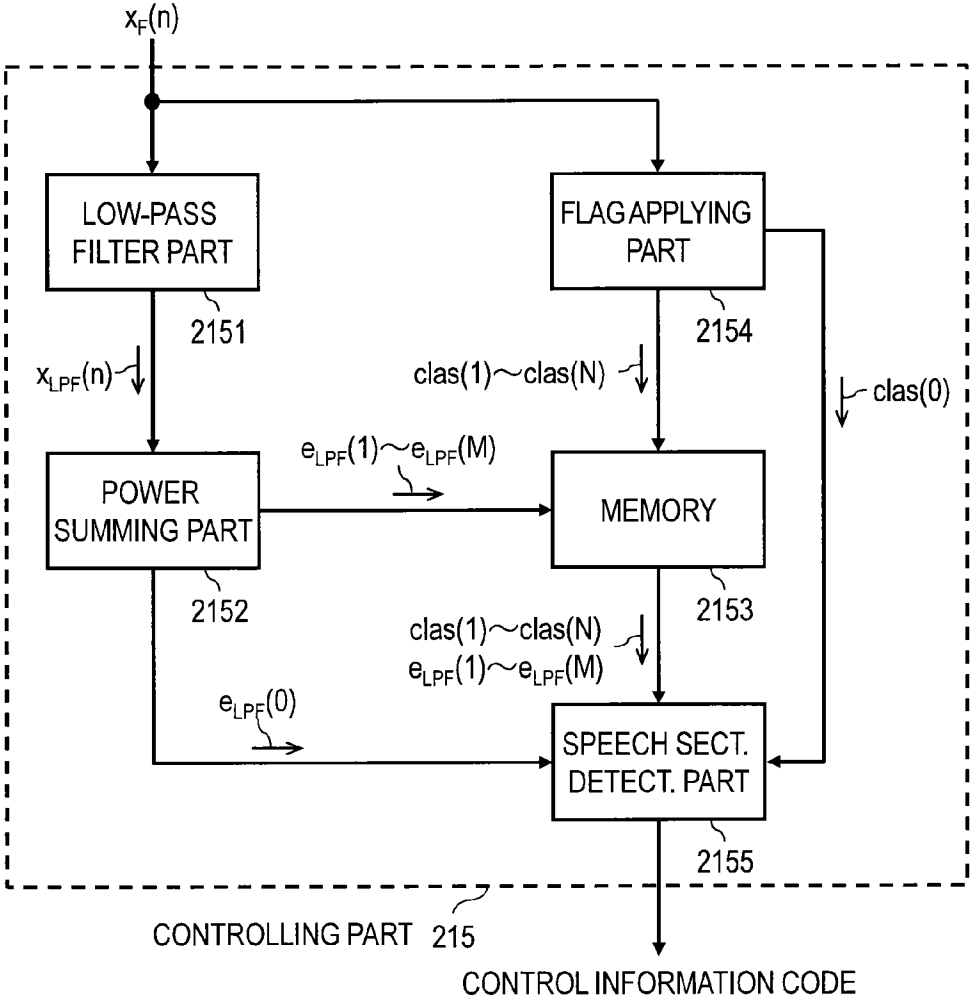
FIG. 7 is a block diagram showing a configuration of a controlling part of the encoding apparatus according to the first embodiment.
Figure 8:
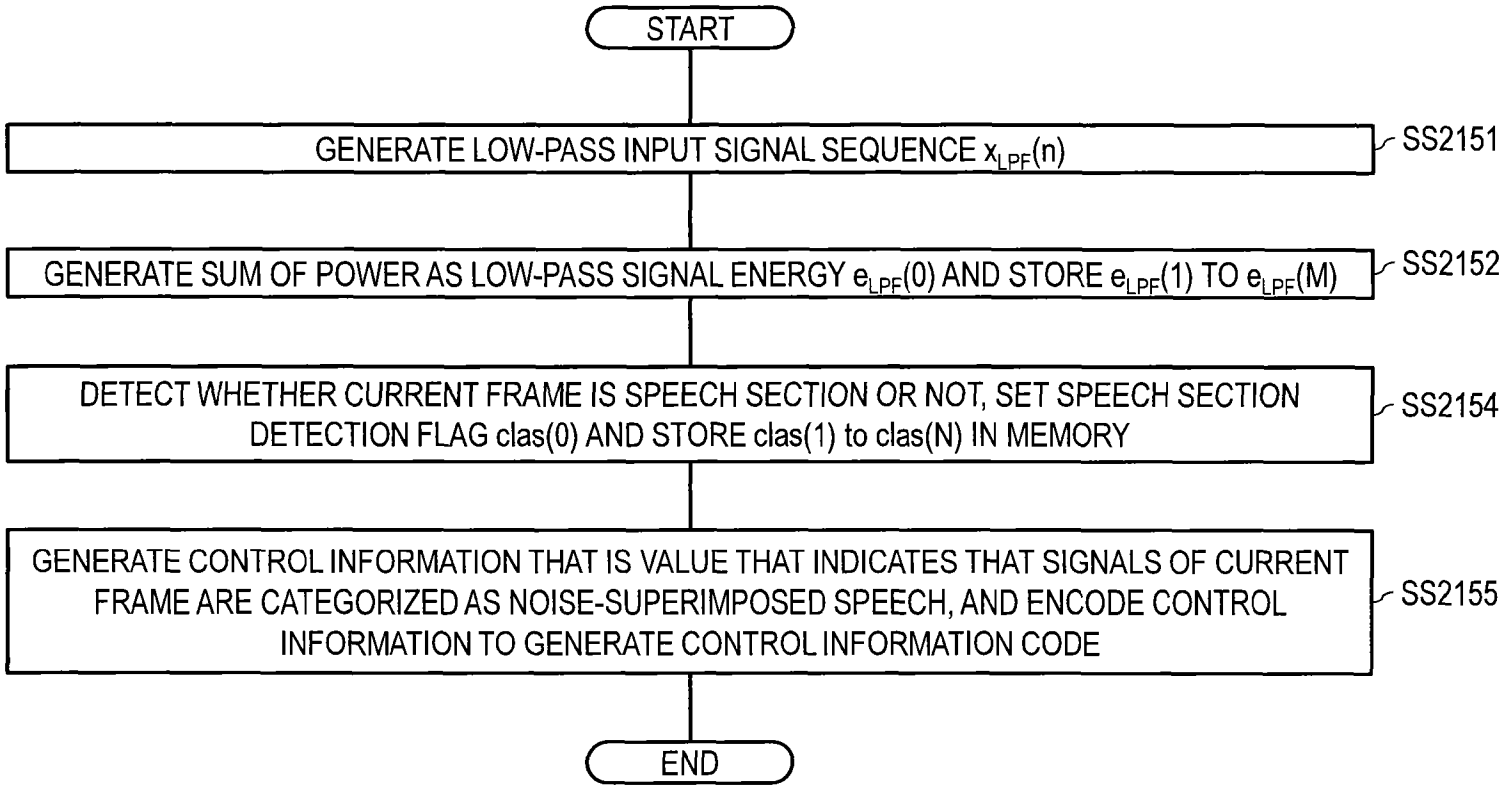
FIG. 8 is a flow chart showing an operation of the controlling part of the encoding apparatus according to the first embodiment.

With reference to FIGS. 5 to 8, an encoding apparatus 3 according to a first embodiment will be described. FIG. 5 is a block diagram showing a configuration of the encoding apparatus 3 according to this embodiment. FIG. 6 is a flow chart showing an operation of the encoding apparatus 3 according to this embodiment. FIG. 7 is a block diagram showing a configuration of a controlling part 215 of the encoding apparatus 3 according to this embodiment. FIG. 8 is a flow chart showing an operation of the controlling part 215 of the encoding apparatus 3 according to this embodiment.

As shown in FIG. 5, the encoding apparatus 3 according to this embodiment comprises a linear prediction analysis part 101, a linear prediction coefficient encoding part 102, a synthesis filter part 103, a waveform distortion calculating part 104, a code book search controlling part 105, a gain code book part 106, a driving sound source vector generating part 107, a synthesis part 208, and a controlling part 215. The encoding apparatus 3 differs from the encoding apparatus 1 according to prior art only in that the synthesis part 108 in the prior art example is replaced with the synthesis part 208 in this embodiment, and the encoding apparatus 3 is additionally provided with the controlling part 215. The operations of the components denoted by the same reference numerals as those of the encoding apparatus 1 according to prior art are the same as described above and therefore will not be further described. In the following, operations of the controlling part 215 and the synthesis part 208, which differentiate the encoding apparatus 3 from the encoding apparatus 1 according to prior art, will be described.

<Controlling Part 215>

The controlling part 215 receives an input signal sequence $x_F(n)$ in units of frames and generates a control information code (S215). More specifically, as shown in FIG. 7, the controlling part 215 comprises a low-pass filter part 2151, a power summing part 2152, a memory 2153, a flag applying part 2154, and a speech section detecting part 2155. The low-pass filter part 2151 receives an input signal sequence $x_F(n)$ in units of frames that is composed of a plurality of consecutive samples (on the assumption that one frame is a sequence of L signals 0 to L−1), performs a filtering processing on the input signal sequence $x_F(n)$ using a low-pass filter to generate a low-pass input signal sequence $x_{LPF}(n)$, and outputs the low-pass input signal sequence $x_{LPF}(n)$ (SS2151). For the filtering processing, an infinite impulse response (IIR) filter or a finite impulse response (FIR) filter can be used. Alternatively, other filtering processings may be used.

Then, the power summing part 2152 receives the low-pass input signal sequence $x_{LPF}(n)$, and calculates a sum of the power of the low-pass input signal sequence $x_{LPF}(n)$ as a low-pass signal energy $e_{LPF}(0)$ according to the following formula, for example (SS2152).

[Formula 1]

$$e_{LPF}(0) = \sum_{n=0}^{L-1} [x_{LPF}(n)]^2 \tag{1}$$

The power summing part 2152 stores the calculated low-pass signal energies for a predetermined number M of previous frames (M=5, for example) in the memory 2153 (SS2152). For example, the power summing part 2152 stores, in the memory 2153, the low-pass signal energies $e_{LPF}(1)$ to $e_{LPF}(M)$ for frames from the first frame prior to the current frame to the M-th frame prior to the current frame.

Then, the flag applying part 2154 detects whether the current frame is a section that includes a speech or not (referred to as a speech section, hereinafter), and substitutes a value into a speech section detection flag clas(0) (SS2154). For example, if the current frame is a speech section, clas(0)=1, and if the current frame is not a speech section, clas(0)=0. The speech section can be detected in a commonly used voice activity detection (VAD) method or any other method that can detect a speech section. Alternatively, the speech section detection may be a vowel section detection. The VAD method is used to detect a silent section for information compression in ITU-T G.729 Annex B (Non-patent reference literature 1), for example.

The flag applying part 2154 stores the speech section detection flags clas for a predetermined number N of previous frames (N=5, for example) in the memory 2153 (SS2152). For example, the flag applying part 2154 stores, in the memory 2153, speech section detection flags clas(1) to clas(N) for frames from the first frame prior to the current frame to the N-th frame prior to the current frame.

(Non-Patent Reference Literature 1) A Benyassine, E Shlomot, H-Y Su, D Massaloux, C Lamblin, J-P Petit, ITU-T recommendation G.729 Annex B: a silence compression scheme for use with G.729 optimized for V.70 digital simultaneous voice and data applications. IEEE Communications Magazine 35(9), 64-73 (1997)

Then, the speech section detecting part 2155 performs speech section detection using the low-pass signal energies $e_{LPF}(0)$ to $e_{LPF}(M)$ and the speech section detection flags clas(0) to clas(N) (SS2155). More specifically, if all the low-pass signal energies $e_{LPF}(0)$ to $e_{LPF}(M)$ as parameters are greater than a predetermined threshold, and all the speech section detection flags clas(0) to clas(N) as parameters are 0 (that is, the current frame is not a speech section nor a vowel section), the speech section detecting part 2155 generates, as the control information code, a value (control information) that indicates that the signals of the current frame are categorized as a noise-superimposed speech, and outputs the value to the synthesis part 208 (SS2155). Otherwise, the control information for the immediately preceding frame is carried over. That is, if the input signal sequence of the immediately preceding frame is a noise-superimposed speech, the current frame is also a noise-superimposed speech, and if the immediately preceding frame is not a noise-superimposed speech, the current frame is also not a noise-superimposed speech. An initial value of the control information may or may not be a value that indicates the noise-superimposed speech. For example, the control information is output as binary (1-bit) information that indicates whether the input signal sequence is a noise-superimposed speech or not.

<Synthesis Part 208>

The synthesis part 208 operates basically the same as the synthesis part 108 except that the control information code is additionally input to the synthesis part 208. That is, the synthesis part 208 receives the control information code, the linear prediction code and the driving sound source code and generates a synthetic code thereof (S208).

Figure 9:
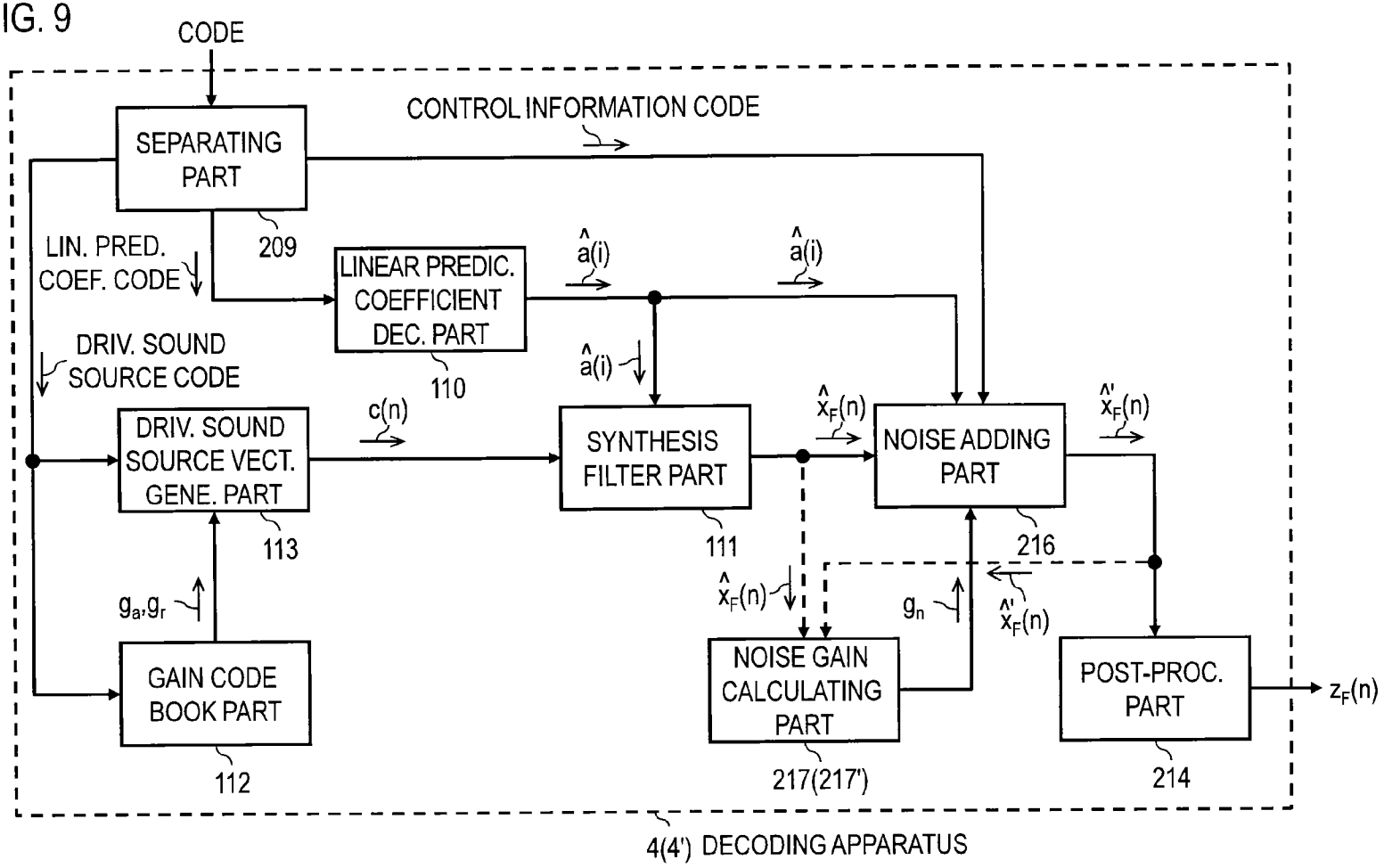
FIG. 9 is a block diagram showing a configuration of a decoding apparatus according to the first embodiment and a modification thereof.
Figure 10:
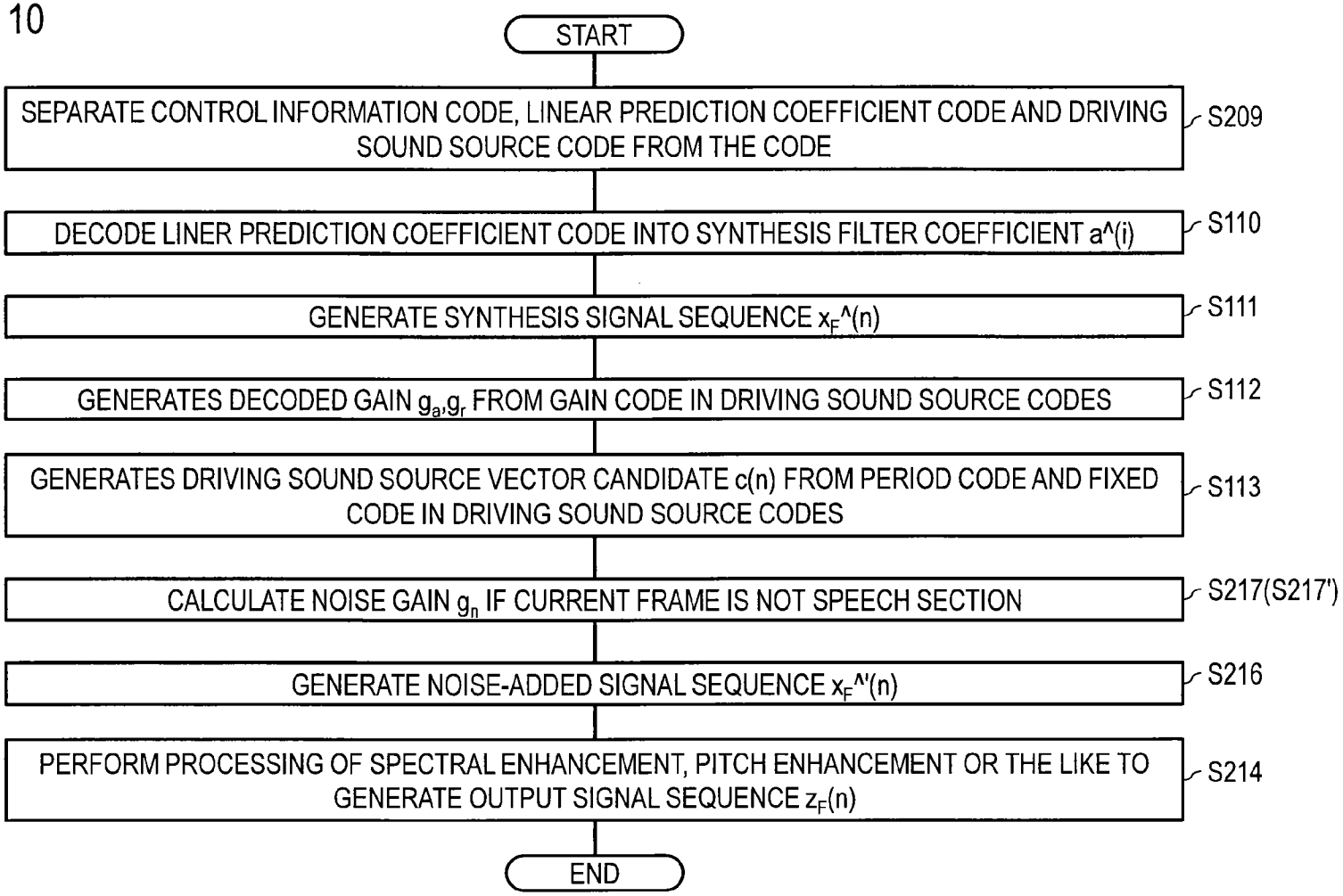
FIG. 10 is a flow chart showing an operation of the decoding apparatus according to the first embodiment and the modification thereof.
Figure 11:
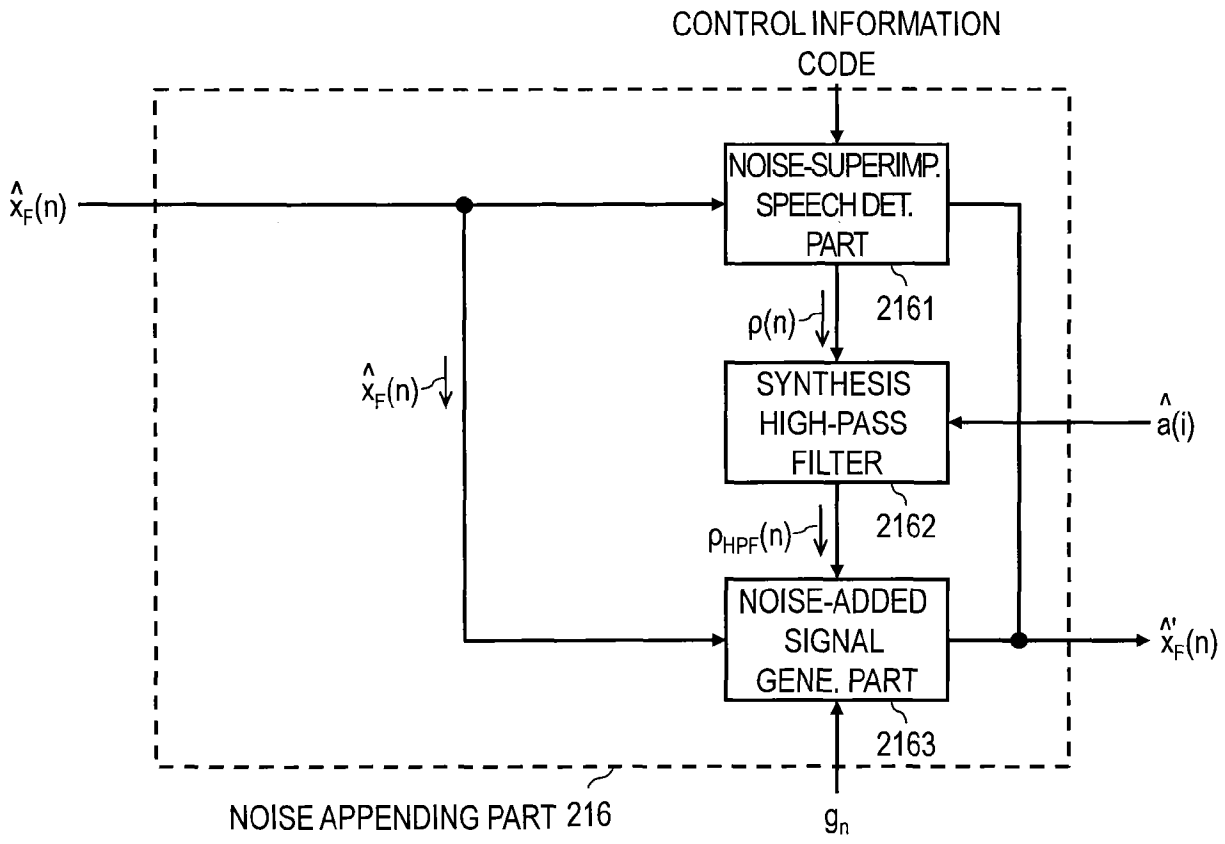
FIG. 11 is a block diagram showing a configuration of a noise appending part of the decoding apparatus according to the first embodiment and the modification thereof.
Figure 12:
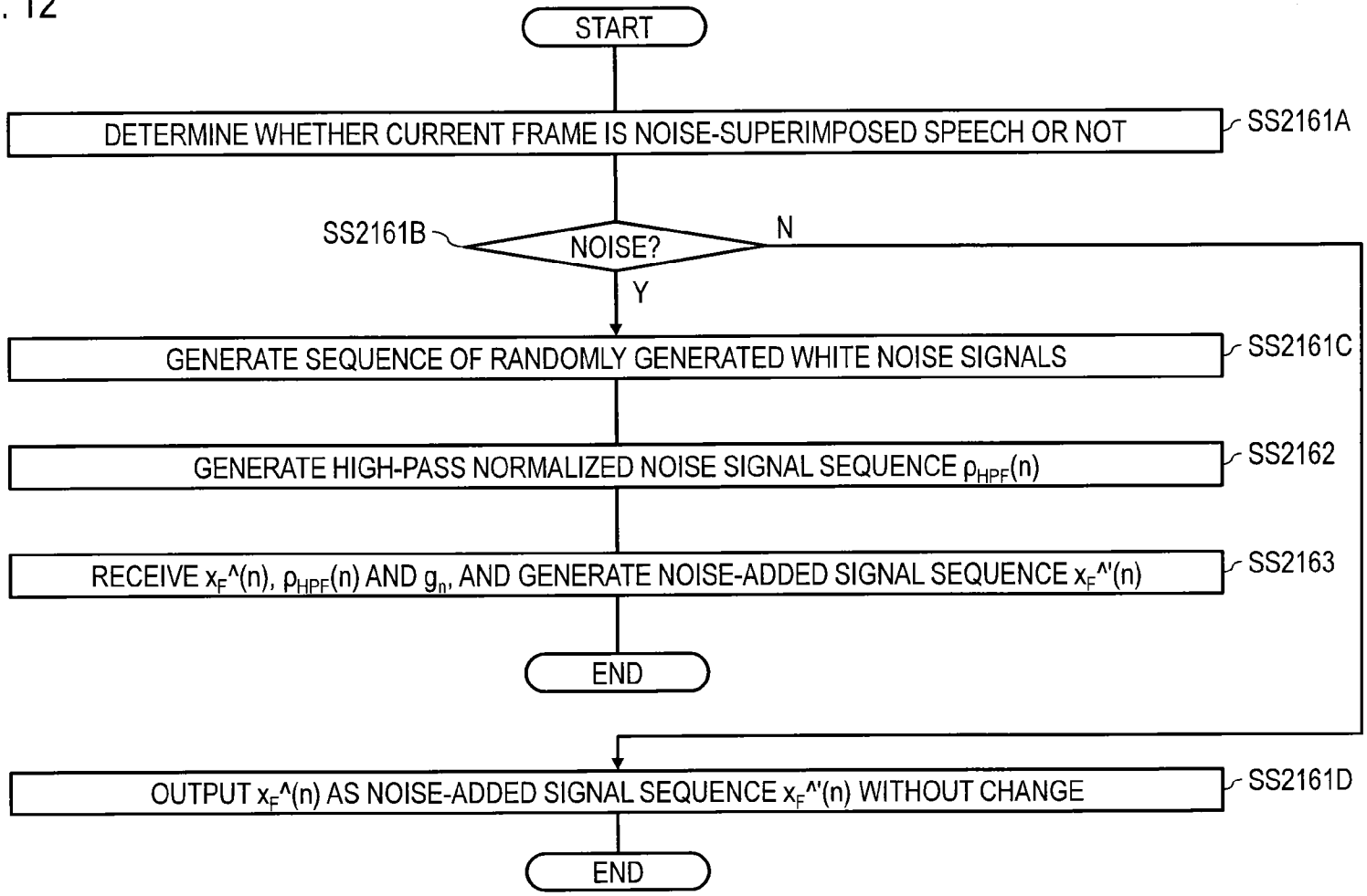
FIG. 12 is a flow chart showing an operation of the noise appending part of the decoding apparatus according to the first embodiment and the modification thereof.

Next, with reference to FIGS. 9 to 12, a decoding apparatus 4 according to the first embodiment will be described. FIG. 9 is a block diagram showing a configuration of the decoding apparatus 4(4') according to this embodiment and a modification thereof. FIG. 10 is a flow chart showing an operation of the decoding apparatus 4(4') according to this embodiment and the modification thereof. FIG. 11 is a block diagram showing a configuration of a noise appending part 216 of the decoding apparatus 4 according to this embodiment and the modification thereof. FIG. 12 is a flow chart showing an operation of the noise appending part 216 of the decoding apparatus 4 according to this embodiment and the modification thereof.

As shown in FIG. 9, the decoding apparatus 4 according to this embodiment comprises a separating part 209, a linear prediction coefficient decoding part 110, a synthesis filter part 111, a gain code book part 112, a driving sound source vector generating part 113, a post-processing part 214, a noise appending part 216, and a noise gain calculating part 217. The decoding apparatus 4 differs from the decoding apparatus 2 according to prior art only in that the separating part 109 in the prior art example is replaced with the separating part 209 in this embodiment, the post-processing part 114 in the prior art example is replaced with the post-processing part 214 in this embodiment, and the decoding apparatus 4 is additionally provided with the noise appending part 216 and the noise gain calculating part 217. The operations of the components denoted by the same reference numerals as those of the decoding apparatus 2 according to prior art are the same as described above and therefore will not be further described. In the following, operations of the separating part 209, the noise gain calculating part 217, the noise appending part 216 and the post-processing part 214, which differentiate the decoding apparatus 4 from the decoding apparatus 2 according to prior art, will be described.

<Separating Part 209>

The separating part 209 operates basically the same as the separating part 109 except that the separating part 209 additionally outputs the control information code. That is, the separating part 209 receives the code from the encoding apparatus 3, and separates and retrieves the control information code, the linear prediction coefficient code and the driving sound source code from the code (S209). Then, Steps S112, S113, S110, and S111 are performed.

<Noise Gain Calculating Part 217>

Then, the noise gain calculating part 217 receives the synthesis signal sequence $x_F\hat{}(n)$, and calculates a noise gain $g_n$ according to the following formula if the current frame is a section that is not a speech section, such as a noise section (S217).

[Formula 2]

$$g_n = \sqrt{\frac{1}{L}\sum_{n=0}^{L-1}[\hat{x}_F(n)]^2} \tag{2}$$

The noise gain $g_n$ may be updated by exponential averaging using the noise gain determined for a previous frame according to the following formula

[Formula 3]

$$g_n \leftarrow \varepsilon\sqrt{\frac{1}{L}\sum_{n=0}^{L-1}[\hat{x}_F(n)]^2} + (1-\varepsilon)g_n \tag{3}$$

An initial value of the noise gain $g_n$ may be a predetermined value, such as 0, or a value determined from the synthesis signal sequence $x_F\hat{}(n)$ for a certain frame. $\epsilon$ denotes a forgetting coefficient that satisfies a condition that $0<\epsilon\leq 1$ and determines a time constant of an exponential attenuation. For example, the noise gain $g_n$ is updated on the assumption that $\epsilon=0.6$. The noise gain $g_n$ may also be calculated according to the formula (4) or (5).

[Formula 4]

$$g_n = \sqrt{\sum_{n=0}^{L-1} [\hat{x}_F(n)]^2} \tag{4}$$

$$g_n \leftarrow \varepsilon \sqrt{\sum_{n=0}^{L-1} [\hat{x}_F(n)]^2} + (1-\varepsilon) g_n \tag{5}$$

Whether the current frame is a section that is not a speech section, such as a noise section, or not may be detected in the commonly used voice activity detection (VAD) method described in Non-patent reference literature 1 or any other method that can detect a section that is not a speech section.

<Noise Appending Part 216>

The noise appending part 216 receives the synthesis filter coefficient $a^\wedge(i)$, the control information code, the synthesis signal sequence $x_F^\wedge(n)$, and the noise gain $g_n$, generates a noise-added signal sequence $x_F^{\wedge\prime}(n)$, and outputs the noise-added signal sequence $x_F^{\wedge\prime}(n)$ (S216).

More specifically, as shown in FIG. 11, the noise appending part 216 comprises a noise-superimposed speech determining part 2161, a synthesis high-pass filter part 2162, and a noise-added signal generating part 2163. The noise-superimposed speech determining part 2161 decodes the control information code into the control information, determines whether the current frame is categorized as the noise-superimposed speech or not, and if the current frame is a noise-superimposed speech (S2161BY), generates a sequence of L randomly generated white noise signals whose amplitudes assume values ranging from −1 to 1 as a normalized white noise signal sequence ρ(n) (SS2161C). Then, the synthesis high-pass filter part 2162 receives the normalized white noise signal sequence ρ(n), performs a filtering processing on the normalized white noise signal sequence ρ(n) using a composite filter of the high-pass filter and the synthesis filter dulled to come closer to the general shape of the noise to generate a high-pass normalized noise signal sequence $\rho_{HPF}(n)$, and outputs the high-pass normalized noise signal sequence $\rho_{HPF}(n)$ (SS2162). For the filtering processing, an infinite impulse response (IIR) filter or a finite impulse response (FIR) filter can be used. Alternatively, other filtering processings may be used. For example, the composite filter of the high-pass filter and the dulled synthesis filter, which is denoted by H(z), may be defined by the following formula.

[Formula 5]

$$H(z) = H_{HPF}(z) / \hat{A}(z/\gamma_n) \tag{6}$$

$$\hat{A}(z) = 1 - \sum_{i=1}^{q} \hat{a}(i) z^{-i} \tag{7}$$

In these formulas, $H_{HPF}(z)$ denotes the high-pass filter, and $A^\wedge(Z/\gamma_n)$ denotes the dulled synthesis filter. q denotes a linear prediction order and is 16, for example. $\gamma_n$ is a parameter that dulls the synthesis filter to come closer to the general shape of the noise and is 0.8, for example.

A reason for using the high-pass filter is as follows. In the encoding scheme based on the speech production model, such as the CELP-based encoding scheme, a larger number of bits are allocated to high-energy frequency bands, so that the sound quality intrinsically tends to deteriorate in higher frequency bands. If the high-pass filter is used, however, more noise can be added to the higher frequency bands in which the sound quality has deteriorated whereas no noise is added to the lower frequency bands in which the sound quality has not significantly deteriorated. In this way, a more natural sound that is not audibly deteriorated can be produced.

The noise-added signal generating part 2163 receives the synthesis signal sequence $x_F^\wedge(n)$, the high-pass normalized noise signal sequence $\rho_{HPF}(n)$, and the noise gain $g_n$ described above, and calculates a noise-added signal sequence $x_F^{\wedge\prime}(n)$ according to the following formula, for example (SS2163).

[Formula 6]

$$\hat{x}'_F(n) = \hat{x}_F(n) + C_n g_n \rho_{HPF}(n) \tag{8}$$

In this formula, $C_n$ denotes a predetermined constant that adjusts the magnitude of the noise to be added, such as 0.04.

On the other hand, if in Sub-step SS2161B the noise-superimposed speech determining part 2161 determines that the current frame is not a noise-superimposed speech (SS2161BN), Sub-steps SS2161C, SS2162, and SS2163 are not performed. In this case, the noise-superimposed speech determining part 2161 receives the synthesis signal sequence $x_F^\wedge(n)$, and outputs the synthesis signal sequence $x_F^\wedge(n)$ as the noise-added signal sequence $x_F^{\wedge\prime}(n)$ without change (SS2161D). The noise-added signal sequence $x_F^\wedge(n)$ output from the noise-superimposed speech determining part 2161 is output from the noise appending part 216 without change.

<Post-Processing Part 214>

The post-processing part 214 operates basically the same as the post-processing part 114 except that what is input to the post-processing part 214 is not the synthesis signal sequence but the noise-added signal sequence. That is, the post-processing part 214 receives the noise-added signal sequence $x_F^{\wedge\prime}(n)$, performs a processing of spectral enhancement or pitch enhancement on the noise-added signal sequence $x_F^{\wedge\prime}(n)$ to generate an output signal sequence $z_F(n)$ with a less audible quantized noise and outputs the output signal sequence $z_F(n)$ (S214).

[First Modification]

In the following, with reference to FIGS. 9 and 10, a decoding apparatus 4' according to a modification of the first embodiment will be described. As shown in FIG. 9, the decoding apparatus 4' according to this modification comprises a separating part 209, a linear prediction coefficient decoding part 110, a synthesis filter part 111, a gain code book part 112, a driving sound source vector generating part 113, a post-processing 214, a noise appending part 216, and a noise gain calculating part 217'. The decoding apparatus 4' differs from the decoding apparatus 4 according to the first embodiment only in that the noise gain calculating part 217 in the first embodiment is replaced with the noise gain calculating part 217' in this modification.

<Noise Gain Calculating Part 217'>

The noise gain calculating part 217' receives the noise-added signal sequence $x_F^{\wedge\prime}(n)$ instead of the synthesis signal sequence $x_F^\wedge(n)$, and calculates the noise gain $g_n$ according to the following formula, for example, if the current frame is a section that is not a speech section, such as a noise section (S217').

[Formula 7]

$$g_n = \sqrt{\frac{1}{L}\sum_{n=0}^{L-1}[\hat{x}'_F(n)]^2} \quad (2')$$

As with the case described above, the noise gain $g_n$ may be calculated according to the following formula (3').

[Formula 8]

$$g_n \leftarrow \varepsilon\sqrt{\frac{1}{L}\sum_{n=0}^{L-1}[\hat{x}'_F(n)]^2} + (1-\varepsilon)g_n \quad (3')$$

As with the case described above, the noise gain $g_n$ may be calculated according to the following formula (4') or (5').

[Formula 9]

$$g_n = \sqrt{\sum_{n=0}^{L-1}[\hat{x}'_F(n)]^2} \quad (4')$$

$$g_n \leftarrow \varepsilon\sqrt{\sum_{n=0}^{L-1}[\hat{x}'_F(n)]^2} + (1-\varepsilon)g_n \quad (5')$$

As described above, with the encoding apparatus 3 and the decoding apparatus 4(4') according to this embodiment and the modification thereof, in the speech coding scheme based on the speech production model, such as the CELP-based scheme, even if the input signal is a noise-superimposed speech, the quantization distortion caused by the model not being applicable to the noise-superimposed speech is masked so that the uncomfortable sound becomes less perceivable, and a more natural sound can be reproduced.

In the first embodiment and the modification thereof, specific calculating and outputting methods for the encoding apparatus and the decoding apparatus have been described. However, the encoding apparatus (encoding method) and the decoding apparatus (decoding method) according to the present invention are not limited to the specific methods illustrated in the first embodiment and the modification thereof. In the following, the operation of the decoding apparatus according to the present invention will be described in another manner. The procedure of producing the decoded speech signal (described as the synthesis signal sequence $x_F\hat{}(n)$ in the first embodiment, as an example) according to the present invention (described as Steps S209, S112, S113, S110, and S111 in the first embodiment) can be regarded as a single speech decoding step. Furthermore, the step of generating a noise signal (described as Sub-step SS2161C in the first embodiment, as an example) will be referred to as a noise generating step. Furthermore, the step of generating a noise-added signal (described as Sub-step SS2163 in the first embodiment, as an example) will be referred to as a noise adding step.

In this case, a more general decoding method including the speech decoding step and the noise generating step can be provided. The speech decoding step is to obtain the decoded speech signal (described as $x_F\hat{}(n)$, as an example) from the input code. The noise generating step is to generate a noise signal that is a random signal (described as the normalized white noise signal sequence $\rho(n)$ in the first embodiment, as an example). The noise adding step is to output a noise-added signal (described as $x_F\hat{}'(n)$ in the first embodiment, as an example), the noise-added signal being obtained by summing the decoded speech signal (described as $x_F\hat{}(n)$, as an example) and a signal obtained by performing, on the noise signal (described as $\rho(n)$, as an example), a signal processing based on at least one of a power corresponding to a decoded speech signal for a previous frame (described as the noise gain $g_n$ in the first embodiment, as an example) and a spectrum envelope corresponding to the decoded speech signal for the current frame (filter $A\hat{}(n)$ or $A\hat{}(Z/\gamma_n)$ the first embodiment).

In a variation of the decoding method according to the present invention, the spectrum envelope corresponding to the decoded speech signal for the current frame described above may be a spectrum envelope (described as $A\hat{}(z/\gamma_n)$ in the first embodiment, as an example) obtained by dulling a spectrum envelope corresponding to a spectrum envelope parameter (described as $a\hat{}(i)$ in the first embodiment, as an example) for the current frame provided in the speech decoding step.

Furthermore, the spectrum envelope corresponding to the decoded speech signal for the current frame described above may be a spectrum envelope (described as $A\hat{}(z)$ in the first embodiment, as an example) that is based on a spectrum envelope parameter (described as $a\hat{}(i)$, as an example) for the current frame provided in the speech decoding step.

Furthermore, the noise adding step described above may be to output a noise-added signal, the noise-added signal being obtained by summing the decoded speech signal and a signal obtained by imparting the spectrum envelope (described as the filter $A\hat{}(z)$ or $A\hat{}(z/\gamma_n)$, as an example) corresponding to the decoded speech signal for the current frame to the noise signal (described as $\rho(n)$, as an example) and multiplying the resulting signal by the power (described as $g_n$, as an example) corresponding to the decoded speech signal for the previous frame.

The noise adding step described above may be to output a noise-added signal, the noise-added signal being obtained by summing the decoded speech signal and a signal with a low frequency band suppressed or a high frequency band emphasized (illustrated in the formula (6) in the first embodiment, for example) obtained by imparting the spectrum envelope corresponding to the decoded speech signal for the current frame to the noise signal.

The noise adding step described above may be to output a noise-added signal, the noise-added signal being obtained by summing the decoded speech signal and a signal with a low frequency band suppressed or a high frequency band emphasized (illustrated in the formula (6) or (8), for example) obtained by imparting the spectrum envelope corresponding to the decoded speech signal for the current frame to the noise signal and multiplying the resulting signal by the power corresponding to the decoded speech signal for the previous frame.

The noise adding step described above may be to output a noise-added signal, the noise-added signal being obtained by summing the decoded speech signal and a signal obtained by imparting the spectrum envelope corresponding to the decoded speech signal for the current frame to the noise signal.

The noise adding step described above may be to output a noise-added signal, the noise-added signal being obtained by summing the decoded speech signal and a signal obtained by multiplying the noise signal by the power corresponding to the decoded speech signal for the previous frame.

The various processings described above can be performed not only sequentially in the order described above but also in parallel with each other or individually as required or depending on the processing power of the apparatus that performs the processings. Furthermore, of course, other various modifications can be appropriately made to the processings without departing from the spirit of the present invention.

In the case where the configurations described above are implemented by a computer, the specific processings of the apparatuses are described in a program. The computer executes the program to implement the processings described above.

The program that describes the specific processings can be recorded in a computer-readable recording medium. The computer-readable recording medium may be any type of recording medium, such as a magnetic recording device, an optical disk, a magneto-optical recording medium or a semiconductor memory.

The program may be distributed by selling, transferring or lending a portable recording medium, such as a DVD or a CD-ROM, in which the program is recorded, for example. Alternatively, the program may be distributed by storing the program in a storage device in a server computer and transferring the program from the server computer to other computers via a network.

The computer that executes the program first temporarily stores, in a storage device thereof, the program recorded in a portable recording medium or transferred from a server computer, for example. Then, when performing the processings, the computer reads the program from the recording medium and performs the processings according to the read program. In an alternative implementation, the computer may read the program directly from the portable recording medium and perform the processings according to the program. As a further alternative, the computer may perform the processings according to the program each time the computer receives the program transferred from the server computer. As a further alternative, the processings described above may be performed on an application service provider (ASP) basis, in which the server computer does not transmit the program to the computer, and the processings are implemented only through execution instruction and result acquisition.

The programs according to the embodiment of the present invention include a quasi-program that is information provided for processing by a computer (such as data that is not a direct instruction to a computer but has a property that defines the processings performed by the computer). Although the apparatus according to the present invention in the embodiment described above is implemented by a computer executing a predetermined program, at least part of the specific processing may be implemented by hardware.

What is claimed is:

1. A decoding method, comprising:

a speech decoding step of obtaining a current frame of a decoded speech signal from an input code;

a noise generating step of generating a noise signal that is a random signal; and a noise adding step of outputting a noise-added signal, the noise-added signal being obtained by summing said decoded speech signal and a signal obtained by performing, on said noise signal, a signal processing that is based on a spectrum envelope corresponding to the decoded speech signal for the current frame, wherein the spectrum envelope corresponding to the decoded speech signal for said current frame is a spectrum envelope obtained by dulling a spectrum envelope corresponding to a linear predictive coefficient for the current frame provided in said speech decoding step, wherein the dulling operation is an operation which operates a predetermined constant to the linear predictive coefficient for the current frame.

2. The decoding method according claim 1, wherein said noise adding step is to output a noise-added signal, the noise-added signal being obtained by summing said decoded speech signal and a signal obtained by imparting the spectrum envelope corresponding to the decoded speech signal for said current frame to said noise signal and multiplying the resulting signal by the power corresponding to the decoded speech signal for said previous frame.

3. The decoding method according to claim 1, wherein said noise adding step is to output a noise-added signal, the noise-added signal being obtained by summing said decoded speech signal and a signal with a low frequency band suppressed or a high frequency band emphasized obtained by imparting the spectrum envelope corresponding to the decoded speech signal for said current frame to said noise signal.

4. The decoding method according to claim 1, wherein said noise adding step is to output a noise-added signal, the noise-added signal being obtained by summing said decoded speech signal and a signal with a low frequency band suppressed or a high frequency band emphasized obtained by imparting the spectrum envelope corresponding to the decoded speech signal for said current frame to said noise signal and multiplying the resulting signal by the power corresponding to the decoded speech signal for said previous frame.

5. A decoding apparatus, comprising:

processing circuitry configured to obtain a current frame of a decoded speech signal from an input code;

generate a noise signal that is a random signal; and output a noise-added signal, the noise-added signal being obtained by summing said decoded speech signal and a signal obtained by performing, on said noise signal, a signal processing that is based on a spectrum envelope corresponding to the decoded speech signal for the current frame, wherein the spectrum envelope corresponding to the decoded speech signal for said current frame is a spectrum envelope obtained by dulling a spectrum envelope corresponding to a linear predictive coefficient for the obtained current frame, wherein the dulling operation is an operation which operates a predetermined constant to the linear predictive coefficient for the current frame.

6. The decoding apparatus according to claim 5, wherein said processing circuitry outputs a noise-added signal, the noise-added signal being obtained by summing said decoded speech signal and a signal obtained by imparting the spectrum envelope corresponding to the decoded speech signal for said current frame to said noise signal and multiplying the resulting signal by the power corresponding to the decoded speech signal for said previous frame.

7. The decoding apparatus according to claim 5, wherein said processing circuitry outputs a noise-added signal, the noise-added signal being obtained by summing said decoded speech signal and a signal with a low frequency band suppressed or a high frequency band emphasized obtained by imparting the spectrum envelope corresponding to the decoded speech signal for said current frame to said noise signal.

8. The decoding apparatus according to claim 5, wherein said processing circuitry outputs a noise-added signal, the noise-added signal being obtained by summing said decoded speech signal and a signal with a low frequency band suppressed or a high frequency band emphasized obtained by imparting the spectrum envelope corresponding to the decoded speech signal for said current frame to said noise signal and multiplying the resulting signal by the power corresponding to the decoded speech signal for said previous frame.

9. A non-transitory computer-readable recording medium that stores a program that makes a decoding apparatus perform a decoding method, comprising:

a speech decoding step of obtaining a current frame of a decoded speech signal from an input code;

a noise generating step of generating a noise signal that is a random signal; and a noise adding step of outputting a noise-added signal, the noise-added signal being obtained by summing said decoded speech signal and a signal obtained by performing, on said noise signal, a signal processing that is based on a spectrum envelope corresponding to the decoded speech signal for the current frame, wherein the spectrum envelope corresponding to the decoded speech signal for said current frame is a spectrum envelope obtained by dulling a spectrum envelope corresponding to a linear predictive coefficient for the current frame provided in said speech decoding step, wherein the dulling operation is an operation which operates a predetermined constant to the linear predictive coefficient for the current frame.

* * * * *